US009765614B2

(12) United States Patent
Taherian et al.

(10) Patent No.: US 9,765,614 B2
(45) Date of Patent: Sep. 19, 2017

(54) WIRELESS COMMUNICATION AND TELEMETRY FOR COMPLETIONS

(71) Applicant: SCHLUMBERGER TECHNOLOGY CORPORATION, Sugar Land, TX (US)

(72) Inventors: Reza Taherian, Missouri City, TX (US); Stephen Dyer, Rosharon, TX (US); Julius Kusuma, Arlington, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 105 days.

(21) Appl. No.: 14/763,885

(22) PCT Filed: Jan. 23, 2014

(86) PCT No.: PCT/US2014/012775

§ 371 (c)(1),
(2) Date: Jul. 28, 2015

(87) PCT Pub. No.: WO2014/120556

PCT Pub. Date: Aug. 7, 2014

(65) Prior Publication Data

US 2015/0361787 A1 Dec. 17, 2015

Related U.S. Application Data

(60) Provisional application No. 61/758,118, filed on Jan. 29, 2013.

(51) Int. Cl.
*G01V 3/00* (2006.01)
*E21B 47/12* (2012.01)

(52) U.S. Cl.
CPC ..... *E21B 47/122* (2013.01)

(58) Field of Classification Search
CPC ..... E21B 47/122
(Continued)

(56) References Cited

U.S. PATENT DOCUMENTS 4,899,112 A 2/1990 Clark et al.
5,396,232 A 3/1995 Mathieu et al.
(Continued)

OTHER PUBLICATIONS

International Search Report and Written Opinion for corresponding PCT Application Serial No. PCT/US2014/012775, dated Apr. 30, 2014, 15 pages.

*Primary Examiner* — Ojiako Nwugo
(74) *Attorney, Agent, or Firm* — Bridget M. Laffey

(57) ABSTRACT

Wireless communication and electromagnetic telemetry between various surface or downhole devices may be provided using two or more dipole antennas. The dipole antennas may be formed, for example, by electrically isolating, for each electric dipole antenna, two electrically conductive portions. The two electrically conductive portions are part of a downhole casing, a downhole liner, a completion, a production tube, or a downhole tool. The two or more electric dipole antennas are disposed in different sections of a completed well, in one or more lateral wells, in different completed wells, or in any combination of those. An electromagnetic signal is transmitting from at least one of the two or more dipole antennas and received at any other of the two or more dipole antennas, thereby providing telemetry or wireless communication between the dipole antennas of the petrophysical devices.

17 Claims, 9 Drawing Sheets

(58) Field of Classification Search
USPC ..... 340/854.6
See application file for complete search history.

(56) References Cited

U.S. PATENT DOCUMENTS

| | | | | |
|---|---|---|---|---|
| 9,113,924 | B2 * | 8/2015 | Brannan | A61B 18/18 |
| 2002/0180656 | A1 * | 12/2002 | Pecora, Jr. | H01Q 1/40 343/795 |
| 2005/0056419 | A1 | 3/2005 | Hosie et al. | |
| 2007/0257811 | A1 | 11/2007 | Hall et al. | |
| 2010/0149056 | A1 | 6/2010 | Contant et al. | |
| 2010/0213942 | A1 | 8/2010 | Lazarev | |
| 2011/0248900 | A1 * | 10/2011 | de Rochemont | H01Q 9/26 343/803 |
| 2012/0126993 | A1 | 5/2012 | Samson et al. | |
| 2012/0298420 | A1 * | 11/2012 | Seydoux | E21B 47/02 175/26 |
| 2015/0167452 | A1 * | 6/2015 | Godager | E21B 47/122 340/854.6 |

* cited by examiner

WIRELESS COMMUNICATION AND TELEMETRY FOR COMPLETIONS

BACKGROUND

In the petroleum industry, reservoir monitoring and control systems are often deployed with neither metal conduit nor cable connectivity between them. Nor do they, in many instances, use relay/repeater devices to enable wireless communication. Alternatively, in many cases downhole sensors may be deployed with a metal conduit and cable connectivity to enable ready communication, but the lengths involved often present problems or limit such communication. There also exist measurement-while-drilling (MWD) assemblies and testing tools that exploit certain properties of electric dipole antennas and magnetic dipole antennas (see for example, U.S. Pat. No. 5,396,232). Examples include Schlumberger's EPulse, XEM, Jade, XHop, CLink, and Think tools. Electric dipole tools such as EPulse, Jade and XEM may use the drillstring to improve signal quality. However, the structures and tools used to complete a well have not heretofore been used to provide wireless communication and electromagnetic telemetry.

SUMMARY

Wireless communication and electromagnetic telemetry between various surface or downhole devices may be provided using two or more dipole antennas. The dipole antennas may be formed, for example, by electrically isolating, for each electric dipole antenna, two electrically conductive portions. The two electrically conductive portions are part of a downhole casing, a downhole liner, a completion, a production tube, or a downhole tool. The two or more electric dipole antennas are disposed in different sections of a completed well, in one or more lateral wells, in different completed wells, or in any combination of those. An electromagnetic signal is transmitting from at least one of the two or more dipole antennas and received at any other of the two or more dipole antennas, thereby providing telemetry or wireless communication between the dipole antennas of the petrophysical devices.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion. Embodiments are described with reference to the following figures. The same numbers are generally used throughout the figures to reference like features and components.

DETAILED DESCRIPTION

Figure 1:
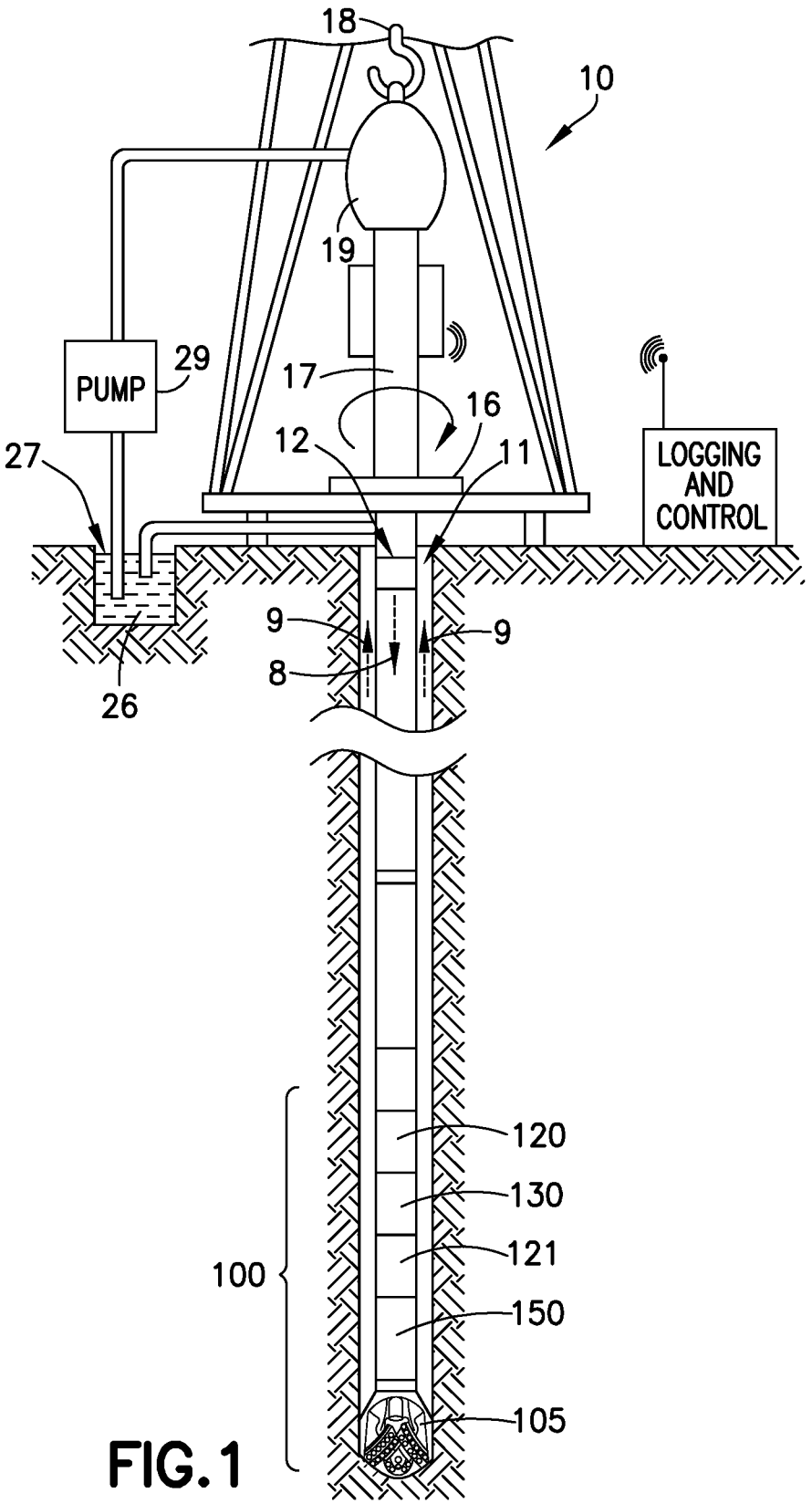
FIG. 1 PRIOR ART
FIG. 1 illustrates a prior art well site system.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 illustrates a well site system in which various embodiments can be employed. The well site can be onshore or offshore. In this example system, a borehole 11 is formed in subsurface formations by rotary drilling in a manner that is well known. Some embodiments can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11, the assembly 10 including a rotary table 16, kelly 17, hook 18 and rotary swivel 19. The drill string 12 is rotated by the rotary table 16, energized by means not shown, which engages the kelly 17 at the upper end of the drill string. The drill string 12 is suspended from a hook 18, attached to a traveling block (also not shown), through the kelly 17 and a rotary swivel 19 which permits rotation of the drill string relative to the hook. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid to flow downwardly through the drill string 12 as indicated by the directional arrow 8. The drilling fluid exits the drill string 12 via ports in the drill bit 105, and then circulates upwardly through the annulus region between the outside of the drill string and the wall of the borehole, as indicated by the directional arrows 9. In this well known manner, the drilling fluid lubricates the drill bit 105 and carries formation cuttings up to the surface as it is returned to the pit 27 for recirculation.

The bottom hole assembly 100 of the illustrated embodiment includes a logging-while-drilling (LWD) module 120 and a measuring-while-drilling (MWD) module 130. It may also include a roto-steerable system and motor 150 and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 121. (References, throughout, to a module at the position of 120 can alternatively mean a module at the position of 121 as well.) The LWD module includes capabilities for measuring, processing, and storing information, as well as for communicating with the surface equipment. In the present embodiment, the LWD module includes a resistivity measuring device.

The MWD module 130 is also housed in a special type of drill collar, as is known in the art, and can contain one or more devices for measuring characteristics of the drill string and drill bit. The MWD tool further includes an apparatus (not shown) for generating electrical power to the downhole system. This may typically include a mud turbine generator powered by the flow of the drilling fluid, it being understood that other power and/or battery systems may be employed. In the present embodiment, the MWD module includes one or more of the following types of measuring devices: a weight-on-bit measuring device, a torque measuring device, a vibration measuring device, a shock measuring device, a stick/slip measuring device, a direction measuring device, and an inclination measuring device.

Figure 2:
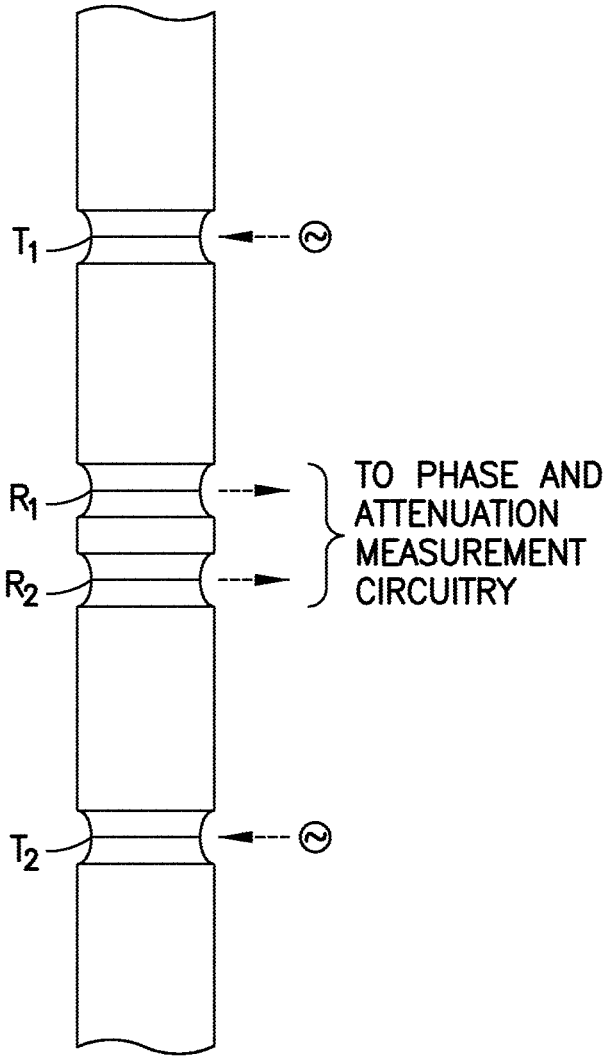
FIG.2 PRIOR ART
FIG. 2 shows a prior art logging tool.

An example of a tool which can be the LWD tool 120, or can be a part of an LWD tool suite 121, is shown in FIG. 2. As seen in FIG. 2, upper and lower transmitting antennas, $T_1$ and $T_2$, have upper and lower receiving antennas, $R_1$ and $R_2$, therebetween. The antennas are formed as coils or magnetic dipoles placed in recesses in a modified drill collar and mounted in MC or insulating material. The phase shift of the electromagnetic wave between the receivers provides an indication of formation resistivity at a relatively shallow depth of investigation, and the attenuation of the electromagnetic wave between the receivers provides an indication of formation resistivity at a relatively deep depth of investigation. U.S. Pat. No. 4,899,112 can be referred to for further details. In operation, attenuation-representative signals and phase-representative signals are coupled to a processor, an output of which is coupleable to a telemetry circuit.

Some electromagnetic (EM) logging tools use one or more tilted or transverse antennas, with or without axial antennas. Those antennas may be transmitters or receivers. A tilted antenna is one whose dipole moment is neither parallel nor perpendicular to the longitudinal axis of the tool. A transverse antenna is one whose dipole moment is perpendicular to the longitudinal axis of the tool, and an axial antenna is one whose dipole moment is parallel to the longitudinal axis of the tool. A triaxial antenna is one in which three antennas (i.e., antenna coils) are arranged to be mutually orthogonal. Often one antenna (coil) is axial and the other two are transverse. Two antennas are said to have equal angles if their dipole moment vectors intersect the tool's longitudinal axis at the same angle. For example, two tilted antennas have the same tilt angle if their dipole moment vectors, having their tails conceptually fixed to a point on the tool's longitudinal axis, lie on the surface of a right circular cone centered on the tool's longitudinal axis and having its vertex at that reference point. Transverse antennas have equal angles of 90 degrees, and that is true regardless of their azimuthal orientations relative to the tool.

Some embodiments will now be described with reference to the figures. Like elements in the various figures may be referenced with like numbers for consistency. In the following description, numerous details are set forth to provide an understanding of various embodiments and/or features. However, it will be understood by those skilled in the art that some embodiments may be practiced without many of these details and that numerous variations or modifications from the described embodiments are possible. As used here, the terms "above" and "below", "up" and "down", "upper" and "lower", "upwardly" and "downwardly", and other like terms indicating relative positions above or below a given point or element are used in this description to more clearly describe certain embodiments. However, when applied to equipment and methods for use in wells that are deviated or horizontal, such terms may refer to a left to right, right to left, or diagonal relationship, as appropriate. It will also be understood that, although the terms first, second, etc. may be used herein to describe various elements, these elements should not be limited by these terms. These terms are only used to distinguish one element from another.

The terminology used in the description herein is for the purpose of describing particular embodiments only and is not intended to be limiting. As used in the description and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof.

As used herein, the term "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting

[the stated condition or event]" or "in response to detecting [the stated condition or event]," depending on the context.

A system and method to provide wireless communication between various surface and downhole devices are disclosed. Electromagnetic telemetry may be used to provide the wireless communication and the various devices may include, for example, completion devices, magnetic dipole devices, permanent monitors, and control devices. The various embodiments may be based on electric or magnetic dipole principles. Magnetometers may be used, for example, as sensors. These devices transform large-scale conductive structures such as metal casing or downhole completion equipment into antennas. In one embodiment, antennas (i.e., transformed structures) located in different wells may be used for formation evaluation. The disclosed system and method may be used in conjunction with a computing system as described below.

Figure 3:
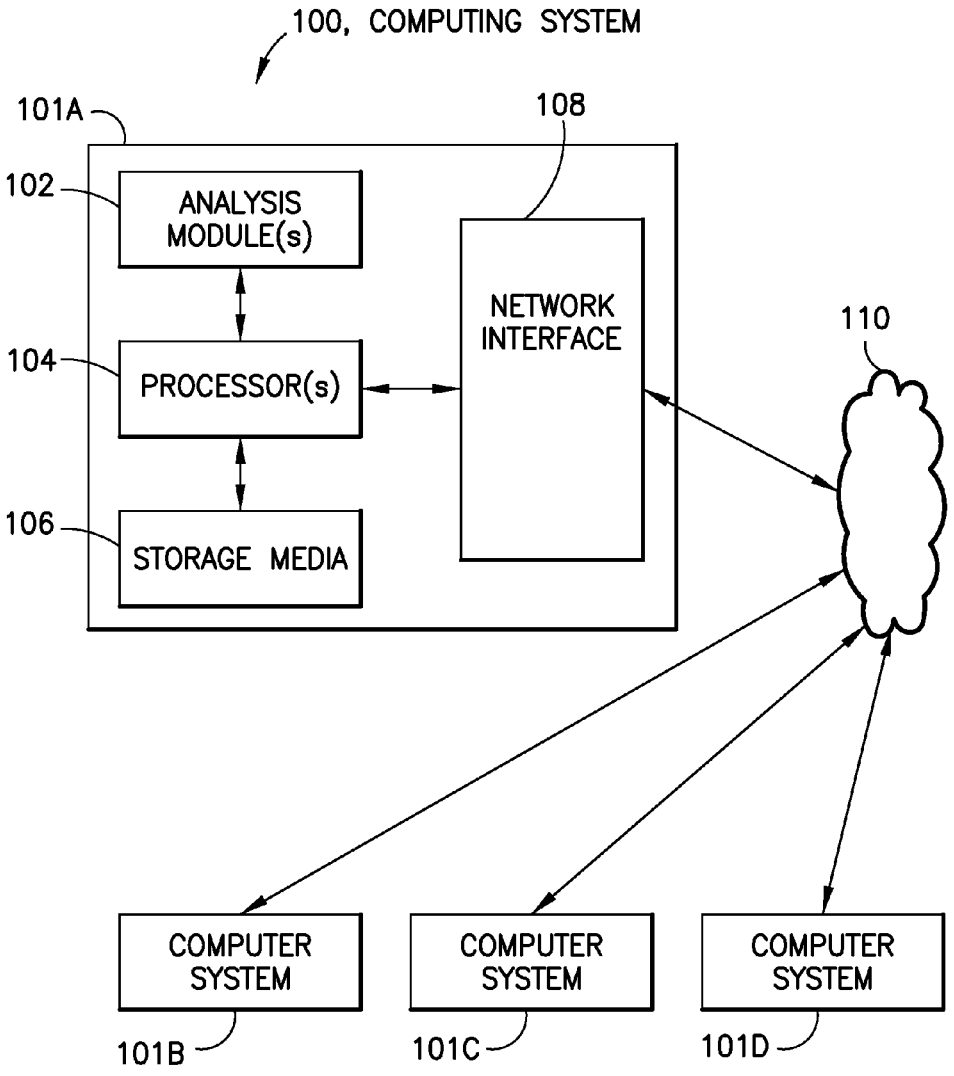
FIG. 3 illustrates an example computing system usable for one or more disclosed embodiments, in accordance with the present disclosure.

The computing system 100 shown in FIG. 3 can be an individual computer system 101A or an arrangement of distributed computer systems. The computer system 101A includes one or more analysis modules 102 that are configured to perform various tasks according to some embodiments, such as one or more methods disclosed herein (e.g., any of the steps, methods, techniques, and/or processes, and/or combinations and/or variations and/or equivalents thereof). To perform those various tasks, analysis module 102 operates independently or in coordination with one or more processors 104 that is (or are) connected to one or more storage media 106. The processor(s) 104 is (or are) also connected to a network interface 108 to allow the computer system 101A to communicate over a data network 110 with one or more additional computer systems and/or computing systems, such as 101B, 101C, and/or 101D (note that computer systems 101B, 101C, and/or 101D may or may not share the same architecture as computer system 101A, and may be located in different physical locations, e.g. computer systems 101A and 101B may be on a ship underway on the ocean, while in communication with one or more computer systems such as 101C and/or 101D that are located in one or more data centers onshore, on other ships, and/or located in various countries on different continents).

A processor can include a microprocessor, microcontroller, processor module or subsystem, programmable integrated circuit, programmable gate array, or another control or computing device.

The storage media 106 can be implemented as one or more computer-readable or machine-readable storage media. Note that while in the example embodiment of FIG. 3 storage media 106 is depicted as within computer system 101A, in some embodiments, storage media 106 may be distributed within and/or across multiple internal and/or external enclosures of computing system 101A and/or additional computing systems. Storage media 106 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices. Note that the instructions discussed above can be provided on one computer-readable or machine-readable storage medium, or alternatively, can be provided on multiple computer-readable or machine-readable storage media distributed in a large system having possibly plural nodes. Such computer-readable or machine-readable storage medium or media is (are) considered to be part of an article (or article of manufacture). An article or article of manufacture can refer to any manufactured single component or multiple components. The storage medium or media can be located either in the machine running the machine-readable instructions, or located at a remote site from which machine-readable instructions can be downloaded over a network for execution.

It should be appreciated that computing system 100 is one example of a computing system, and that computing system 100 may have more or fewer components than shown, may combine additional components not depicted in the example embodiment of FIG. 3, and/or computing system 100 may have a different configuration or arrangement of the components depicted in FIG. 3. For example, though not shown explicitly, computing system 100 would generally include input and output devices such as a keyboard, a mouse, a display monitor, and a printer and/or plotter. The various components shown in FIG. 3 may be implemented in hardware, software, or a combination of hardware and software, including one or more signal processing and/or application specific integrated circuits.

Further, the steps in the processing methods described above may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of this disclosure.

As alluded to above, electric dipoles and/or magnetic dipoles enable wireless telemetry or communication between, for example, various reservoir monitoring and control systems deployed in a completed well. Such monitoring and control equipment may or may not be deployed with metal conduit or cable connectivity between them or to a relay/repeater device. Conductive casing and/or conductive portions of downhole devices such as a tool chassis/housing that are electrically isolated from one another may be used as antennas. For ease of discussion, most of the embodiments described below use electric dipoles, but it is to be understood that magnetic dipoles could easily be adapted for use by one of ordinary skill in the art and are within the scope of this detailed description.

Figure 4:
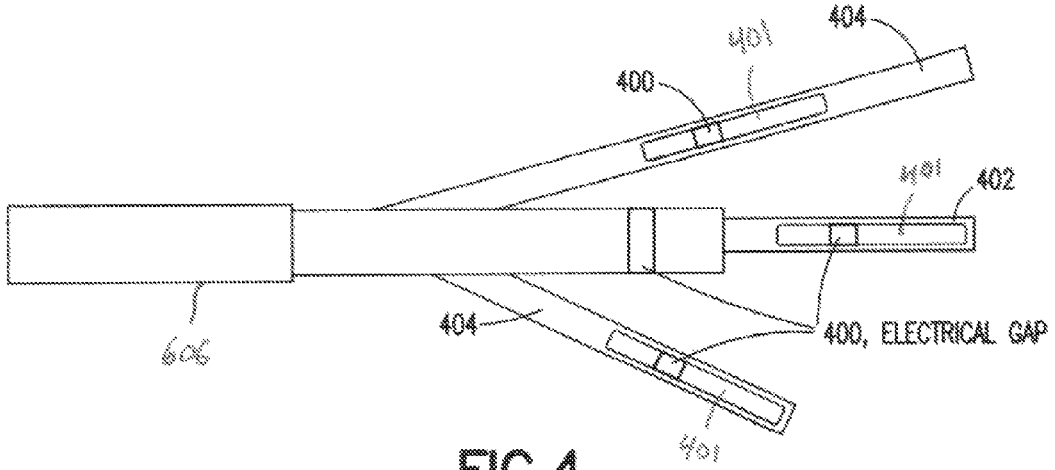
FIG. 4 is a schematic drawing showing electrical gaps built into a casing and various representative downhole devices deployed in the primary wellbore and lateral wellbores, in accordance with the present disclosure.

Electric dipole antennas generally comprise two metallic (i.e., conductive) sections that are substantially aligned and electrically isolated from each other. The sections may be separate structures or they may be part of the same structure having an insulating or electrically isolating gap built-in. In one possible implementation, structural elements can include a casing, a liner, at least a part of a completion, at least a part of a production line, a tool designed for downhole use, or a combination thereof. In one embodiment, the two sections are electrically connected (one piece of metal) with a toroid used to form an electric dipole. It is known in the art that a toroid can cause two sides of the same pipe to virtually act as if they are insulated from each other. In this disclosure the phrases "electrically isolated" or "having a gap" include using a toroid on a single length of a metallic section. FIG. 4 is a schematic drawing showing electrical gaps 400 built into a casing 606 and various representative downhole devices 401 deployed in the primary wellbore 402 and lateral wellbores 404. Each section of an antenna pair may be electrically energized, for example, by providing a potential difference (i.e., voltage) across the corresponding insulating gap 400. The efficiency of these antennas depends, at least in part, on the lengths of the conductive sections relative to the wavelength of the generated electromagnetic wave. For low frequency operations, it is impractical to build and install dedicated devices having electric dipoles with lengths comparable to the wavelength because the wavelength is too long. While dipole lengths much smaller than a wavelength can be used, they cause the dipole antenna to have less than optimal efficiency. However, such shorter dipole antennas may be sufficiently efficient to be useful for telemetry or communication operations at the distances of interest for the embodiments disclosed herein.

In most oil and gas wells there is a cased section which typically is on the order of thousands of feet long. Part or all of the casing length may be used to form an electric dipole antenna. For example, a casing of length L can be made into an electric dipole antenna by separating the casing into two sections, say, approximately in the middle (L/2), and inserting an electrically insulating section in the gap. A source of electrical power can be connected to the electrically separated halves of the casing and an electrical current may be passed into the dipole antenna segments. With this arrangement, the casing can serve as a transmitter. Alternatively, a receiving circuitry can be attached, for example, to or near the insulating gap, and the antenna can be used as a receiver. Alternatively still, both transmitter and receiver circuits may be present and can be switched from one to the other depending on the desired operation.

An electric dipole antenna formed as described above has considerable length, making it capable of efficiently communicating with relatively distant objects, such as devices disposed in horizontal or lateral wells, for example. Various electrical components may be used such as, but not limited to, a voltage source, a current source, or a power source for transmitter and receiver circuitry. Oscillating sources would typically operate in the frequency range of 1-100 Hz for large spacing and at higher frequencies for shorter distances.

Figure 8:
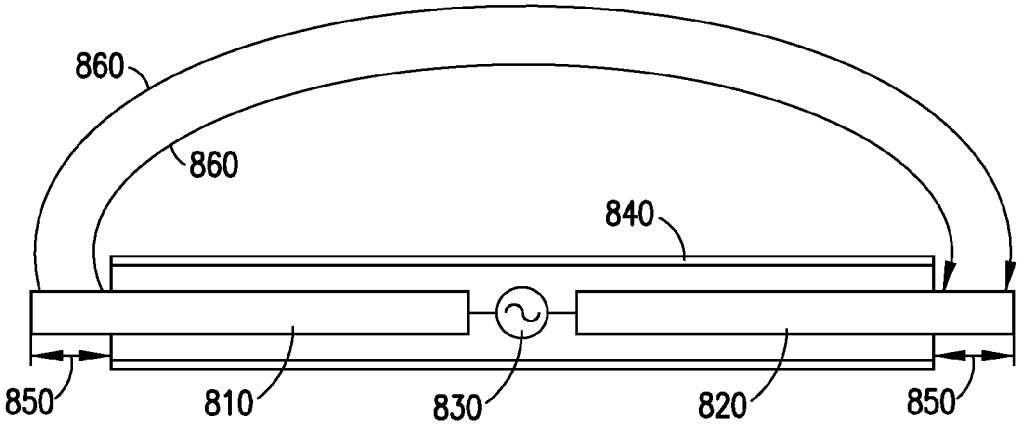
FIG. 8 is a schematic drawing showing an alternate embodiment that may be used and its expected electromagnetic radiation pattern, in accordance with the present disclosure.
Figure 9:
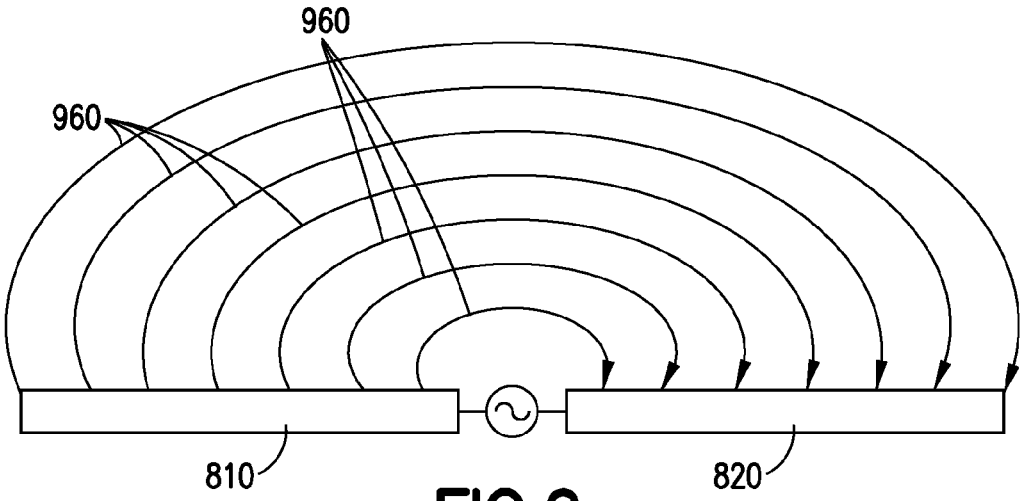
FIG. 9 is a schematic drawing of the embodiment of FIG. 8, but without the insulating sleeve, and shows the expected electromagnetic radiation pattern that would result without the presence of the insulating sleeve.

It is also possible to create an electric dipole antenna using two electrically disconnected conductors both contained within a non-conducting sleeve such as a PVC pipe or plastic housing. As shown in FIG. 8, the two halves or segments 810, 820 of the electric dipole are electrically separated from each other, but driven by an electric power source 830. This assembly is encapsulated in a non-conductive housing (tube) 840 having a length that is shorter than the dipole assembly by a length 850 at each end. As the insulating layer prevents current lines at low frequency to emanate from that part of the dipole segment that is beneath the insulating tube 840, current lines 860 will emanate from one of the exposed lengths 850 and return to the other exposed length 850 (only the upper path is shown). These current lines 860 are to be compared with those in FIG. 9 in which the same dipole is shown but without the insulating housing 840. As this figure shows, many more current lines emanate from and are received by the inner portions of the dipole as compared to those in FIG. 8. The extra current lines in FIG. 9 are shallow-looking current lines and contribute very little to the long range capability of the dipole. Thus, with the design of FIG. 8, it is possible to use less power and achieve the same long range functionality.

A completed well may use some combination of casing, liners, tubing, and "open hole" in the wellbore. For example, the uppermost portion of the wellbore, above any producing zone, may have casing cemented in place. From the lower end of the casing, one or more liners may be "hung" or suspended. In or near the producing zone or zones, the wellbore(s) may be horizontal, meaning the wellbore(s) runs a considerable length within a particular production zone. Those horizontal portions are often left open hole to maximize the contact surface between the formation and the wellbore. In other cases, a slotted liner may be used in a horizontal section.

Completion tubing, if conductive, may be built with a gap in the material such that it can be used as an electric dipole antenna. For example, a long section of slotted liner can be turned into an electric dipole antenna by inserting a small section of non-conductive pipe somewhere along the length of the liner. Alternatively, one or more toroids may be used as described above. Alternatively still, one or more open hole elastomeric packers, such as a swell packer, can provide a suitable gap. Such an antenna can act as transmitter or receiver, as described above, and can be used for formation evaluation as well as telemetry. The conductive portions of the tubing used to form the dipole antenna may be insulated on their interior surfaces such that they are electrically insulated from conductive fluid passing through the tubing.

Figure 10:
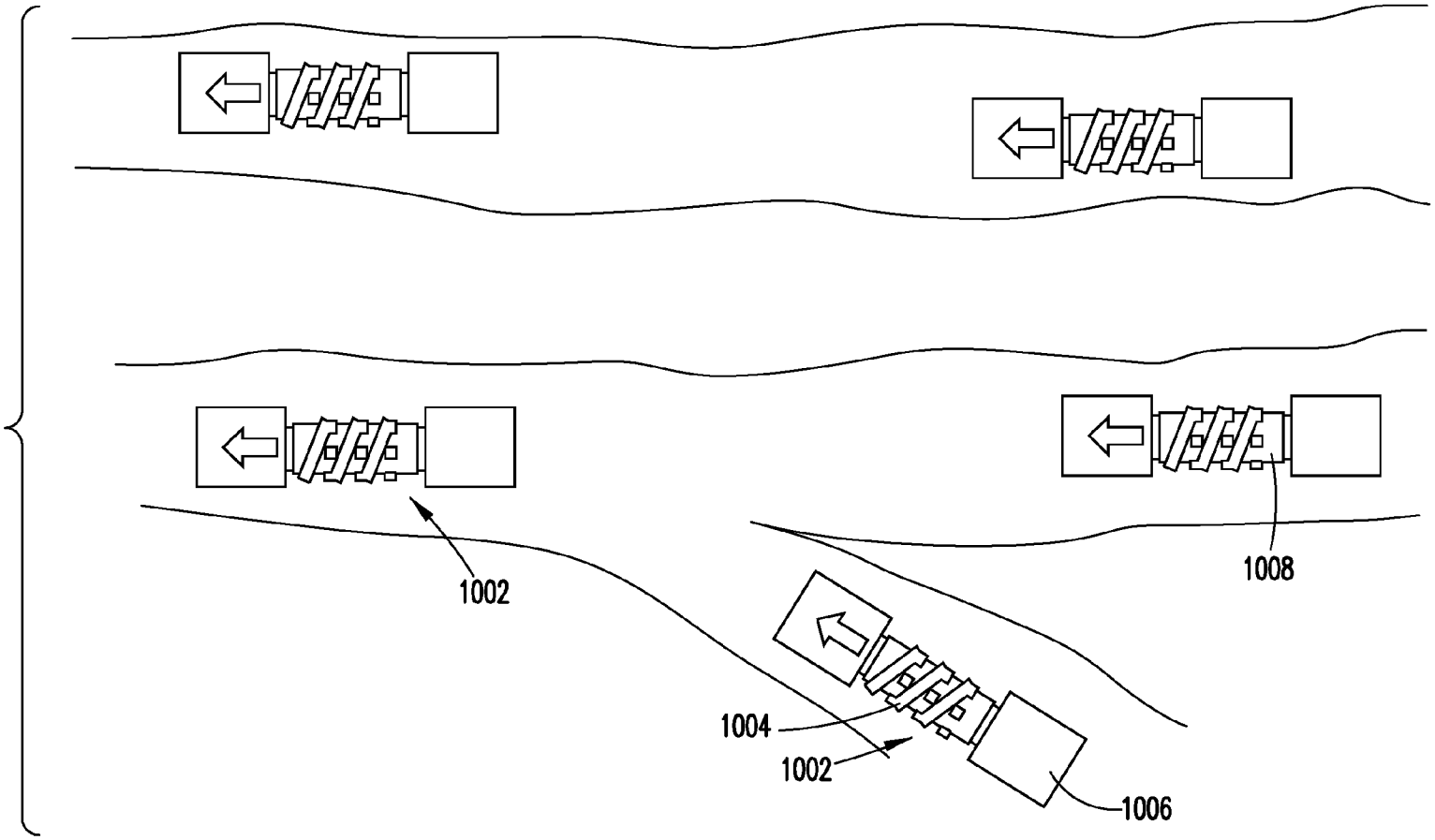
FIG. 10 is a schematic drawing showing an alternate embodiment with representative magnetic dipole antennas variously disposed, in accordance with the present disclosure.

As stated above, various embodiments may use magnetic dipole antennas instead of or in conjunction with electric dipole antennas. Magnetic dipole antennas are routinely used to make measurements from one well to another (i.e., cross-well EM). Those antennas are sufficiently efficient to communicate between two wells located up to 2 km apart. The range of telemetry communication may, however, exceed 2 km for magnetic dipole antennas. As shown in FIG. 10, magnetic dipole antennas 1002 generally comprise one or more loops of electrical conductor 1004 with the conductor's ends connected to a power source (not shown). The size of the loop 1004 can be made so as to fit within the size constraints of a completion. Such a loop 1004 can be formed in a recess on an outer surface of a (metal) housing 1006 that may be, for example, a section of drill collar, a downhole tool, a completion line, etc. A layer of insulating material 1008 such as fiberglass, epoxy, or a magnetic material such as ferrite may be disposed in the recess on the outer surface of the housing 1006, and a coil (i.e., the loops) may be wound on top of this layer of insulating material 1008. A rubber layer (not shown) may cover the coil and the layer of insulating material below, and a slotted shield (not shown) may cover the rubber layer. The described combination is designed to withstand the combined effects of pressure, temperature, and water incursion that are frequently encountered in the borehole environment and may be particularly severe during drilling. Compartments may be formed in the housing 1006 in close proximity to respective receiving coils. The compartments contain impedance matching and pre-amplification circuits for the receiver signals so that those signals are immediately amplified before they are passed through regions of the device where they may be contaminated by noise, such as from the wires carrying the transmitter signals. The structural features of the logging device as set forth and shown in FIG. 10 facilitate the use of borehole compensation in an electromagnetic propagation logging device of a mandrel-type, especially for use in a measurement while drilling apparatus.

Figure 11:
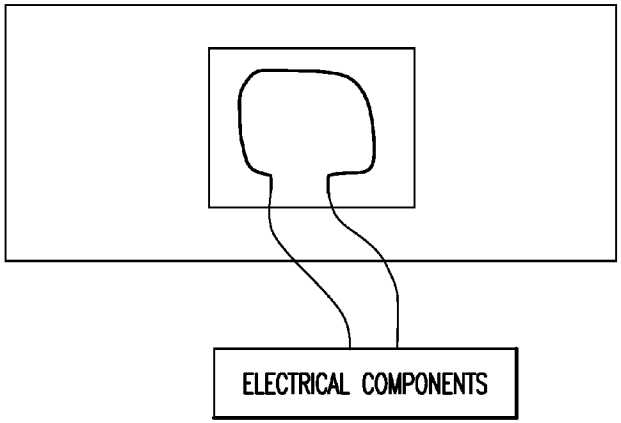
FIG. 11 is a schematic drawing showing a side view of a transverse magnetic dipole antenna, in accordance with the present disclosure.
Figure 12:
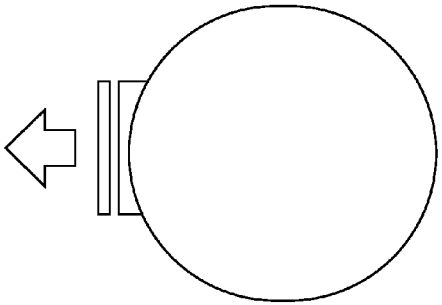
FIG. 12 is a schematic drawing showing an end view of the transverse magnetic dipole antenna of FIG. 11, in accordance with the present disclosure.

As stated above, a coil antenna oriented axially is referred to as an "axial" coil antenna. To obtain a better signal-to-noise ratio, one or more coils may be mounted on the tool such that the normal to the coil is directed radially outward (or inward) relative to the tool's longitudinal axis. Coil antennas oriented in that way are referred to as "azimuthal" or, as stated above, transverse coil antennas. An example of an azimuthal (transverse) coil antenna is shown in FIG. 11 and FIG. 12.

Figure 13:
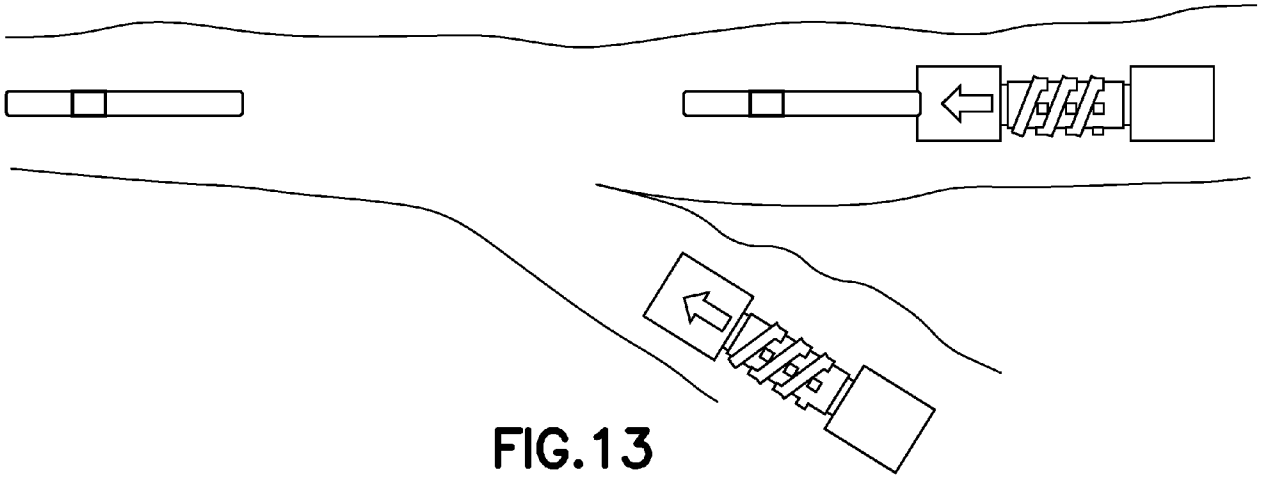
FIG. 13 is a schematic drawing showing an embodiment that uses magnetic dipole antennas, in accordance with the present disclosure.

Note that two parallel antennas of the same kind (i.e., both electric dipoles or both magnetic dipoles) provide the highest received signal level. The signal from a mixed combination in which one antenna is an electric dipole and is in a parallel orientation with a magnetic dipole antenna will have a highly reduced signal level. However, as the two antennas are displaced from each other along the axis of the borehole, or their angular orientation differs from parallel, the signal level increases. Thus, it is possible to communicate between magnetic and electric dipole antennas if they are not parallel and at the same azimuth. Therefore, some embodiments may use magnetic and electric dipole antenna combinations.

Where there are multiple completed sections in a single wellbore, or two or more wellbores, and at least two of those sections or wellbores are equipped with dipole antennas, transmission from one dipole antenna and reception by another produces a signal that has traveled in the space between the two sections of the well or between the wellbores and contains information about that space. (See FIG. 13.) That signal can be inverted to determine, for example, the resistivity or water saturation in the formation. Measurement of formation properties between two wells is normally performed using magnetic dipoles as transmitter and receiver antennas. Currently, when the distance between the two wells is on the order of 1-2 km, the magnetic dipole antennas can be used to perform a cross-well measurement. If instead, electric dipoles are used, the antennas can be made more efficient by increasing the lengths of the two conductive sections. Since the horizontal section of wells is usually on the order of 1 to 3 km, it allows proportionally longer dipole antennas to be made. With such long dipoles, a good measurement of the signal from transmitter to receiver antennas is possible. The data thus obtained can be inverted in a similar manner as the cross-well magnetic dipole signal to obtain, for example, the formation resistivity and water saturation. In one embodiment, the transmitter/receiver signal may be averaged in time to enhance the signal-to-noise ratio. With increasing signal-to-noise ratio, it is possible to use smaller antennas, or to use one large transmitter and multiple receiver antennas. Having more receivers leads to more transmitter/receiver signal measurements and higher spatial resolution in the space between the two wells. In one application, the antennas may be used to map the initial resistivity in the space between the two wells at some initial point in time. As the well is produced, oil is removed from the region and often replaced with water, either naturally or from water flooding. This leads to a change in formation resistivity that can be detected using the embodiments disclosed herein. This is sometimes referred to as a 4-D investigative technique since it involves the dimension of time in addition to spatial coordinates.

Similarly, the signal between the two dipole antennas can be modulated to transmit information between the two or more sections or the two or more wells. Different methods are available for modulating the signal and are well known in the art. For example, amplitude modulation or phase modulation may be used.

Figure 5:
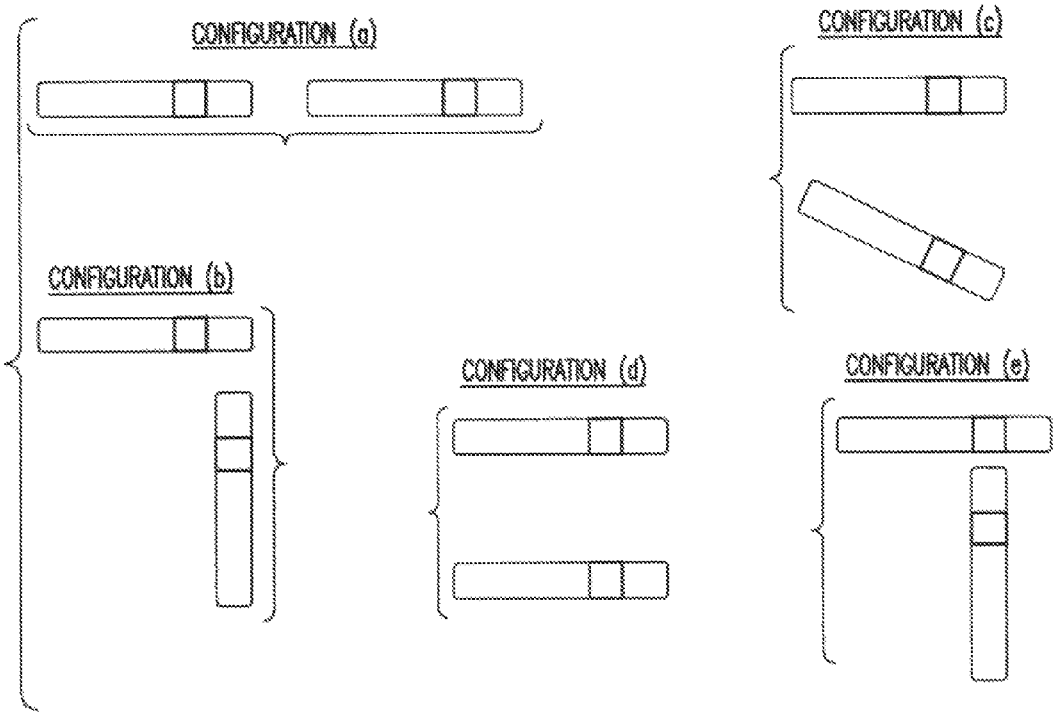
FIG. 5 is a schematic drawing showing five configurations [(a), (b), (c), (d), and (e)] of dipole antenna orientations and locations relative to each other, in accordance with the present disclosure.

The signal strength between two dipole antennas is proportional to their orientation and location relative to each other. In general, if two dipole antennas are oriented parallel to each other and at the same azimuth, the signal level is maximum (see FIG. 5, configuration (d)) At the other extreme, if the two dipole antennas are oriented orthogonally and located in the same azimuth, their radiation patterns are perpendicular to each other and very little signal, if any, is communicated between them. FIG. 5, Configuration (e) shows such an orthogonal orientation with equal azimuths. However, if one of the orthogonally oriented dipole antennas is translated to an azimuthal location different from the other dipole antenna, the signal level increases and communication becomes feasible. (See FIG. 5, Configuration (b).) Similarly, as the orientation of one of the dipole antennas is changed to make it more parallel to the other, the signal level increases. (See FIG. 5, Configuration (c).) In yet another configuration, the two dipole antennas may be inline with one another, providing a reasonable signal. (See FIG. 5, Configuration (a).)

In a completion environment, if there are two wells with a dipole antenna in each well, the angle between the two dipole antennas will be approximately the same as the angle between the two wells. If the two wells are almost parallel, there will be a strong signal between the two dipole antennas. In this case, the two antennas may be positioned as shown in FIG. 5, Configuration (d) for good performance. They can also be laterally displaced relative to each other, if needed. As the two wells become less parallel, the signal level decreases, but remains non-zero. In this case, one of the antennas can be moved such that the two antennas are staggered. That is, while the two dipoles may be end to end (Configuration (a)) or broadside (Configuration (d)), the broadside configuration has the maximum direct coupling between the antennas and is suited for telemetry. This may be understood by considering the current lines for each and noting that the broadside configuration provides the most overlap relative to one another. If at least one of the wells is not permanently completed, it may be possible to move the antennas located in that well and the latter statement applies. If both wells are already completed permanently, then the location of the two dipoles should be chosen based on the configurations shown in FIG. 5 before the completion is finalized.

If the wells have not yet been drilled, it is possible to improve the signal quality for future applications by drilling the wells parallel to each other so that when a device with an electric dipole antenna is deployed within each well, it can communicate with devices in the other approximately parallel lateral or distinct wellbores. Such lateral or distinct wellbores may have casing that can be exploited to improve signal quality.

Figure 6:
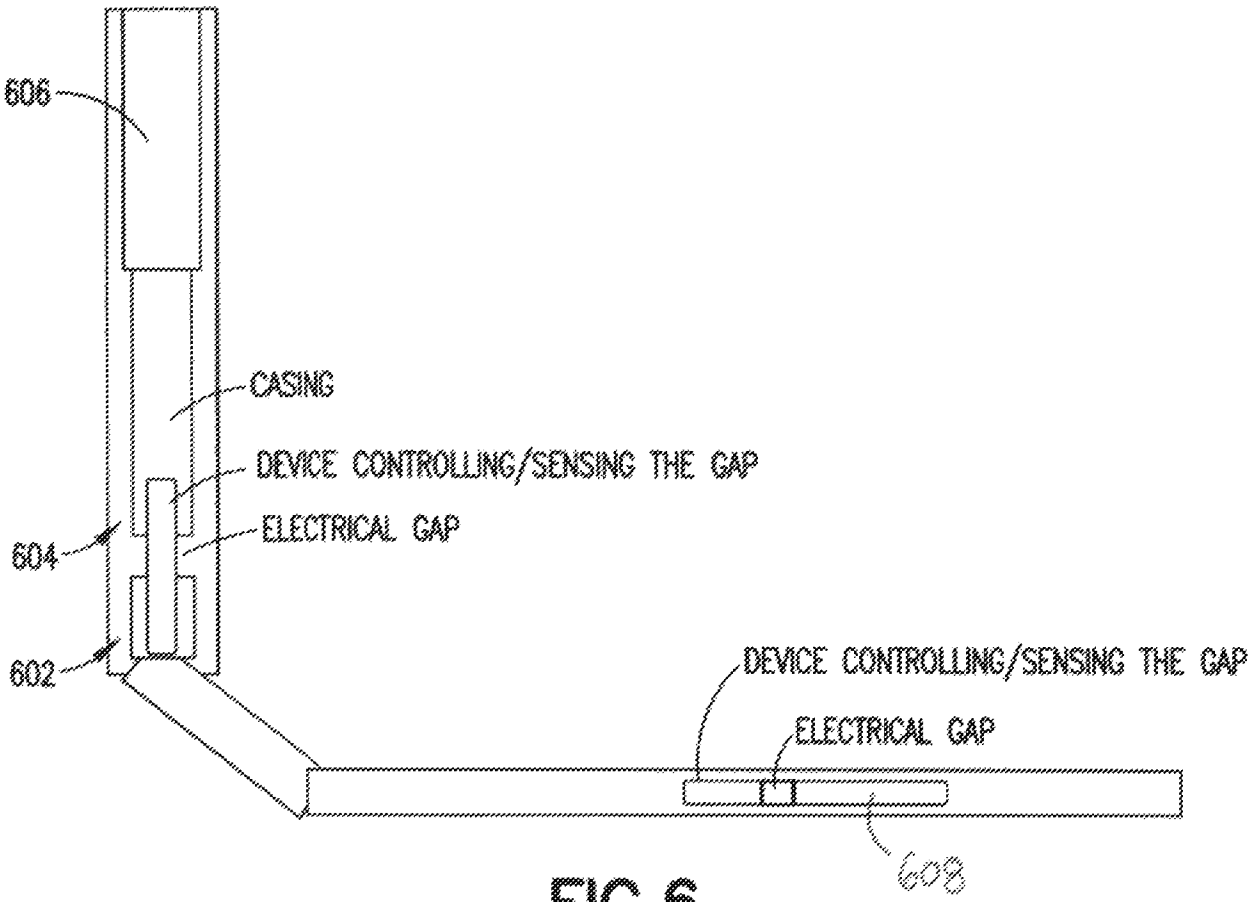
FIG. 6 is a schematic drawing showing an embodiment that may be used to communicate between horizontal and vertical sections of one well, in accordance with the present disclosure.

In addition to communication between different horizontal well sections, or laterals, it is possible to communicate between horizontal and vertical sections of one well, such as shown in FIG. 6. In this case, one dipole antenna 602 can be made by introducing a gap 604 in the casing 606 of the vertical well portion, as described above. Since that casing section is usually very long, it is feasible to use it to communicate with completion devices 608 that are located in the horizontal section at distances on the order of kilometers.

The collection of telemetry devices can form a multi-hop network such that messages can be relayed through various routes. When certain network links' qualities are reduced due to water invasion or other factors, messages can be re-routed through higher quality links. If a device fails, the network can be re-configured.

In such a collection of telemetry devices, different links may use different means of electromagnetic communication. For example, one may use any one of or any combination of electric dipole antennas, axial magnetic dipole antennas, and azimuthal magnetic dipole antennas.

Attention is now directed to processing procedures, methods, techniques, and workflows that are in accordance with some embodiments. Some operations in the processing procedures, methods, techniques, and workflows disclosed herein may be combined and/or the order of some operations may be changed. It is important to recognize that geologic interpretations, sets of assumptions, and/or domain models such as velocity models may be refined in an iterative fashion. This concept is applicable to the processing procedures, methods, techniques, and workflows discussed herein. This iterative refinement can include use of feedback loops executed on an algorithmic basis, such as at a computing device (e.g., computing system 100, FIG. 3), and/or through manual control by a user who may make determinations regarding whether a given step, action, template, or model has become sufficiently accurate for the evaluation of the subsurface three-dimensional geologic formation under consideration.

Figure 7:
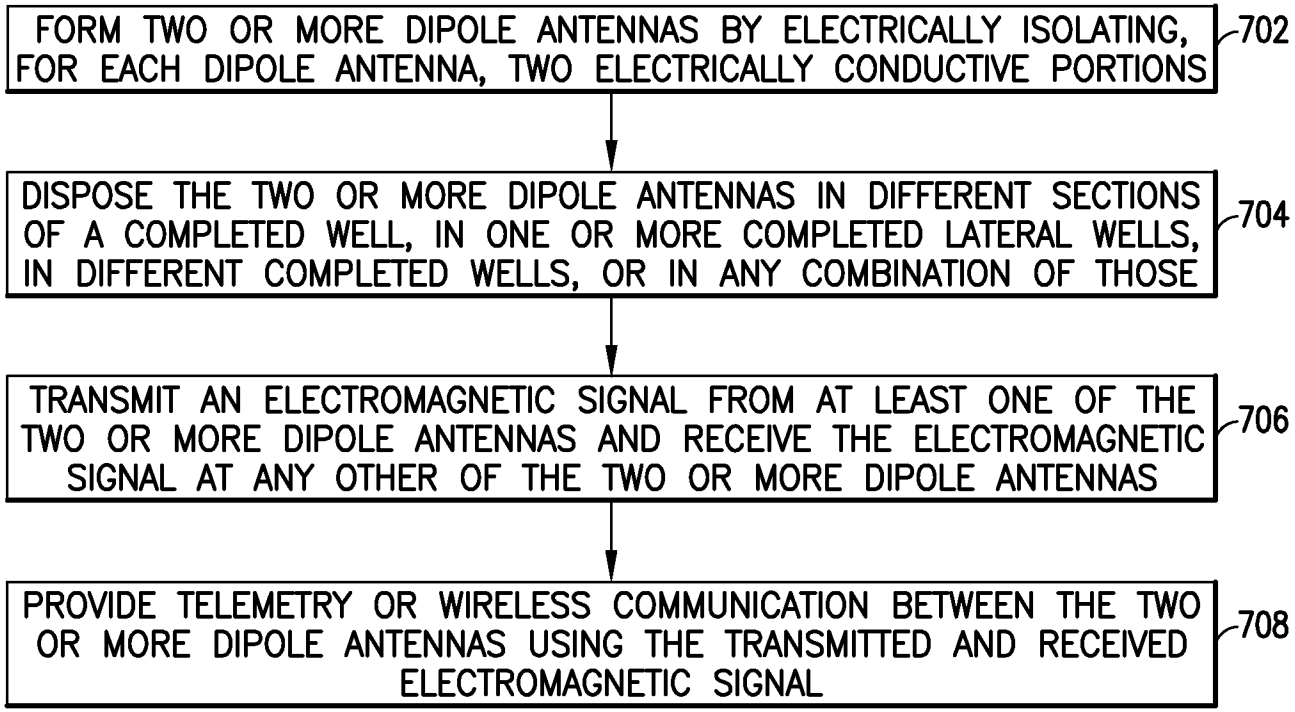
FIG. 7 is a flowchart for at least one workflow embodiment, in accordance with the present disclosure.

FIG. 7 shows a flowchart illustrating an embodiment in accordance with this disclosure. In this embodiment, the workflow comprises forming two or more dipole antennas by electrically isolating, for each dipole antenna, two electrically conductive portions (702); disposing the two or more dipole antennas in different sections of a completed well, in one or more lateral wells, in different completed wells, or in any combination of those (704); transmitting an electromagnetic signal from at least one of the two or more dipole antennas and receiving the electromagnetic signal at any other of the two or more dipole antennas (706); and providing telemetry or wireless communication between the two or more dipole antennas using the transmitted and received electromagnetic signal (708).

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the scope of the present disclosure, and that they may make various changes, substitutions, and alterations herein without departing from the scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

While only certain embodiments have been set forth, alternatives and modifications will be apparent from the above description to those skilled in the art. These and other alternatives are considered equivalents and within the scope of this disclosure and the appended claims. Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A method, comprising:

forming two or more electric dipole antennas by electrically isolating, for each electric dipole antenna, two electrically conductive portions, wherein the two electrically conductive portions comprise portions of a downhole casing, portions of a downhole liner, portions of a completion, portions of a production line, or portions of a downhole tool, and further wherein electrically isolating comprises introducing a gap between the two electrically conductive portions by building the gap into the casing, the liner, the completion, the production line, or the tool, or by creating the gap after the casing, the liner, the completion, the production line, or the tool is disposed downhole;

disposing the two or more electric dipole antennas in different sections of a completed well, in one or more completed lateral wells, in different completed wells, or in any combination of those;

transmitting an electromagnetic signal from at least one of the two or more electric dipole antennas and receiving the electromagnetic signal at any other of the two or more electric dipole antennas; and providing telemetry or wireless communication between the two or more electric dipole antennas using the transmitted and received electromagnetic signal.

2. The method of claim 1 wherein an electrically insulating material is disposed in the gap.

3. The method of claim 1, wherein the transmitting an electromagnetic signal from at least one of the two or more electric dipole antennas comprises, for a particular electric dipole antenna, electrically energizing the two electrically isolated, electrically conductive portions of the electric dipole antenna.

4. The method of claim 1, wherein the providing telemetry or wireless communication between the two or more electric dipole antennas using the transmitted and received electromagnetic signal comprises modulating the electromagnetic signal to transmit information between two or more sections of a wellbore or between two or more wellbores.

5. The method of claim 1, wherein the providing telemetry or wireless communication between the two or more electric dipole antennas using the transmitted and received electromagnetic signal comprises forming a multi-hop network.

6. An apparatus, comprising:

at least two structural elements, each structural element having one or more electrically conductive segments;

two or more electric dipole antennas, each electric dipole antenna being formed from the structural elements and comprising two electrically isolated, electrically conductive portions of the one or more electrically conductive segments, wherein the two electrically isolated, electrically conductive portions are electrically insulated from conductive fluid in an interior region of a pipe; and electrical components electrically connected, pair-wise for each electric dipole antenna, to the electrically isolated, electrically conductive portions of the particular electric dipole antenna.

7. The apparatus of claim 6, wherein the at least two structural elements comprise a casing, a liner, at least a part of a completion, at least a part of a production line, a tool designed for downhole use, or a combination of those, wherein the at least two structural elements may be of the same type or different types.

8. The apparatus of claim 6, wherein each electric dipole antenna has an electrically insulating gap between two electrically isolated, electrically conductive portions or one or more toroids.

9. The apparatus of claim 8, wherein the electrically insulating gap has an electrically insulating material disposed therein.

10. The apparatus of claim 6, wherein one of the at least two electric dipoles are used to transmit electromagnetic energy and the other electric dipole is used to receive the electromagnetic energy.

11. An apparatus, comprising:

a transmitter comprising a first electric dipole antenna, wherein the first electric dipole antenna is formed from two electrically isolated, electrically conductive portions of a downhole casing, a downhole liner, a completion, a production tube, or a downhole tool;

a receiver comprising a second electric dipole antenna, wherein the second electric dipole antenna is formed from two electrically isolated, electrically conductive portions of a downhole casing, a downhole liner, a completion, a production tube, or a downhole tool; and electrical components electrically connected, pair-wise for each electric dipole antenna, to the electrically isolated, electrically conductive portions of the particular electric dipole antenna.

12. The apparatus of claim 11, wherein the electrical components allow the transmitter and the receiver to operate reciprocally.

13. A method, comprising:

forming two or more electric dipole antennas by, for at least one of the electric dipole antennas, electrically isolating two electrically conductive portions using two electrically disconnected conductors contained within a non-conducting sleeve;

disposing the two or more electric dipole antennas in different sections of a completed well, in one or more completed lateral wells, in different completed wells, or in any combination of those;

transmitting an electromagnetic signal from at least one of the two or more electric dipole antennas and receiving the electromagnetic signal at any other of the two or more electric dipole antennas; and providing telemetry or wireless communication between the two or more electric dipole antennas using the transmitted and received electromagnetic signal.

14. An apparatus, comprising:

at least two structural elements, each structural element having one or more electrically conductive segments;

two or more electric dipole antennas, each electric dipole antenna being formed from one or more of the structural elements and comprising two electrically isolated, electrically conductive portions of the one or more electrically conductive segments, wherein at least for one of the one or more electric dipole antennas, the electrically conductive portions are at least partially encapsulated in a non-conducting sleeve; and electrical components electrically connected, pair-wise for each electric dipole antenna, to the electrically isolated, electrically conductive portions of the particular electric dipole antenna.

15. A method, comprising:

forming two or more electric dipole antennas by electrically isolating two electrically conductive portions, wherein at least for one of the two or more electric dipole antennas, the electrically conductive portions are at least partially encapsulated in a non-conducting sleeve;

disposing the two or more electric dipole antennas in different sections of a completed well, in one or more completed lateral wells, in different completed wells, or in any combination of those;

transmitting an electromagnetic signal from at least one of the two or more electric dipole antennas and receiving the electromagnetic signal at any other of the two or more electric dipole antennas, thereby producing an electromagnetic signal that has traveled in a formation located between two sections of a wellbore or between two wellbores and thereby acquired information about the formation; and inverting the produced electromagnetic signal to determine one or more properties of the formation.

16. An apparatus, comprising:

at least two structural elements, each structural element having one or more electrically conductive segments;

two or more electric dipole antennas, each electric dipole antenna being formed from the structural elements and comprising two electrically isolated, electrically conductive portions of the one or more electrically conductive segments;

electrical components electrically connected, pair-wise for each electric dipole antenna, to the electrically isolated, electrically conductive portions of the particular electric dipole antenna; and a processor capable of inverting an electromagnetic signal that has traveled in a formation located between two sections of a wellbore or between two wellbores and thereby acquired information about the formation to determine one or more properties of the formation.

17. A method, comprising:

forming two or more electric dipole antennas by electrically isolating, for each electric dipole antenna, two electrically conductive portions, wherein the two electrically conductive portions are part of a single conductive structure and the electrically isolating comprises using a toroid;

disposing the two or more electric dipole antennas in different sections of a completed well, in one or more completed lateral wells, in different completed wells, or in any combination of those;

transmitting an electromagnetic signal from at least one of the two or more electric dipole antennas and receiving the electromagnetic signal at any other of the two or more electric dipole antennas; and providing telemetry or wireless communication between the two or more electric dipole antennas using the transmitted and received electromagnetic signal.

* * * * *